US005195119A

United States Patent [19]

Ono et al.

[11] Patent Number: 5,195,119

[45] Date of Patent: Mar. 16, 1993

[54] ROTARY-ANODE TYPE X-RAY TUBE

[75] Inventors: Katsuhiro Ono, Utsunomiya; Hidero Anno; Hiroyuki Sugiura, both of Ootawara; Takayuki Kitami, Tochigi; Hiroaki Tazawa, Ootawara, all of Japan

[73] Assignee: Kabushiki Kaisha Toshiba, Kawasaki, Japan

[21] Appl. No.: 766,275

[22] Filed: Sep. 27, 1991

[30] Foreign Application Priority Data

Oct. 5, 1990 [JP] Japan ..... 2-266269
Oct. 5, 1990 [JP] Japan ..... 2-266272

[51] Int. Cl.[5] ..... H01J 35/26
[52] U.S. Cl. ..... 378/133; 378/132
[58] Field of Search ..... 378/132, 133

[56] References Cited

U.S. PATENT DOCUMENTS 3,399,000 8/1968 Remmers ..... 308/9
3,964,805 6/1976 Schulien .
4,210,371 7/1980 Gerkema et al. .
4,641,332 2/1987 Gerkema ..... 378/133

*Primary Examiner*—Craig E. Church
*Attorney, Agent, or Firm*—Cushman, Darby & Cushman

[57] ABSTRACT

In a rotary-anode type X-ray tube, a rotary-anode is fixed to a cylindrical rotary structure, and a columnar stationary shaft is fitted in the rotary structure. A gap is formed between the rotary structure and the stationary shaft. The gap is filled with a liquid metal lubricant. Spiral grooves are formed in part of the outer surface of the stationary shaft to form a radial sliding bearing between the stationary shaft and the rotary structure. Spiral grooves are formed in the end faces of the stationary shaft to form a thrust sliding bearing between the stationary shaft and the rotary structure. A recess is formed in the stationary shaft to communicate with gaps in the radial sliding bearing. A lubricant storage chamber for storing the liquid metal lubricant is formed in the stationary shaft along the center axis. The storage chamber communicates with communicating holes which radially extend to be open to an outer surface region, of the stationary shaft, in which no spiral grooves are formed. With this structure, a sufficient amount of liquid metal lubricant required for a long-term operation of the sliding bearings can be stored in the X-ray tube, thereby maintaining a stable dynamic pressure type sliding bearing operation for a long period of time.

14 Claims, 8 Drawing Sheets

ROTARY-ANODE TYPE X-RAY TUBE

BACKGROUND OF THE INVENTION

1. Field of the Invention

The present invention relates to a rotary-anode type X-ray tube and, more particularly, to an improvement in the structure of a bearing for supporting a rotary-anode type X-ray tube.

2. Description of the Related Art

As is known, in a rotary-anode type X-ray tube, a disk-like anode target is supported by a rotary structure and a stationary shaft which have a bearing portion therebetween, and an electron beam emitted from a cathode is radiated on the anode target while the anode target is rotated at a high speed by energizing an electromagnetic coil arranged outside a vacuum envelope, thus irradiating X-rays. The bearing portion is constituted by a roller bearing, such as a ball bearing, or a hydrodynamic pressure type sliding bearing which has bearing surfaces with spiral grooves and uses a metal lubricant consisting of, e.g., gallium (Ga) or a gallium-, indiumtin (Ga-In-Sn) alloy, which is liquified during an operation. Rotary-anode type X-ray tubes using the latter bearing are disclosed in, e.g., Published Examined Japanese Patent Application No. 60-21463 and Published Unexamined Japanese Patent Application Nos. 60-97536, 60-117531, 62-287555, 2-227947, and 2-227948.

In the rotary-anode type X-ray tubes disclosed in the above-mentioned official gazettes, a liquid metal lubricant consisting of Ga or a Ga-alloy is applied between the bearing surfaces of the sliding bearing. In this arrangement, however, when a tube is processed at a high temperature in the process of manufacturing an X-ray tube, or the tube is heated to a high temperature due to heat generated during an operation of the X-ray tube, mutual penetration may occur between a metal constituting these bearing surfaces and the lubricant, resulting in a gradual decrease in the amount of liquid metal lubricant. This may damage the bearing surfaces. As a result, the sliding bearing may not be stably operated for a long period of time.

SUMMARY OF THE INVENTION

It is an object of the present invention to provide a rotary-anode type X-ray tube which can hold a sufficient amount of liquid metal lubricant for a long-term operation of an X-ray tube, and can maintain a stable bearing operation of a dynamic pressure type sliding bearing for a long period of time.

According to the present invention, there is provided a rotary-anode type X-ray tube comprising:

an anode target;

a rotary structure which has a rotation center axis and to which said anode target is fixed;

a stationary structure, coaxially arranged with said rotary structure, for rotatably holding said rotary structure;

a hydrodynamic bearing formed between said rotary structure and said stationary structure, having a gap in which a metal lubricant is applied, the lubricant being in liquid state during rotation of said rotary structure; and a lubricant storage chamber for receiving the lubricant, which is formed at least one of said stationary and rotary structures, the one of said stationary and rotary structures being arranged on the rotation center axis, to communicate with gaps in said bearing.

According to the rotary-anode type X-ray tube of the present invention, the gaps in the sliding bearings are filled with the liquid metal lubricant, and the liquid metal lubricant is stored in the lubricant storage chamber formed in the stationary shaft or the rotary structure arranged on the rotation axis to communicate with the gaps in the bearings, thereby ensuring a sufficient amount of lubricant required for a long-term operation. Even if the amount of lubricant is reduced to an insufficient level in a given place, since the lubricant stored in the place because of its affinity, a proper lubricating function can be maintained. Therefore, a stable operation of the hydroynamic pressure type sliding bearing can be maintained for a long period of time.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in an constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The preferred embodiments of the rotary-anode type X-ray tube of the present invention will be described below with reference to the accompanying drawings. Note that the same parts are denoted by the same reference numberals throughout the drawings.

Figure 1:
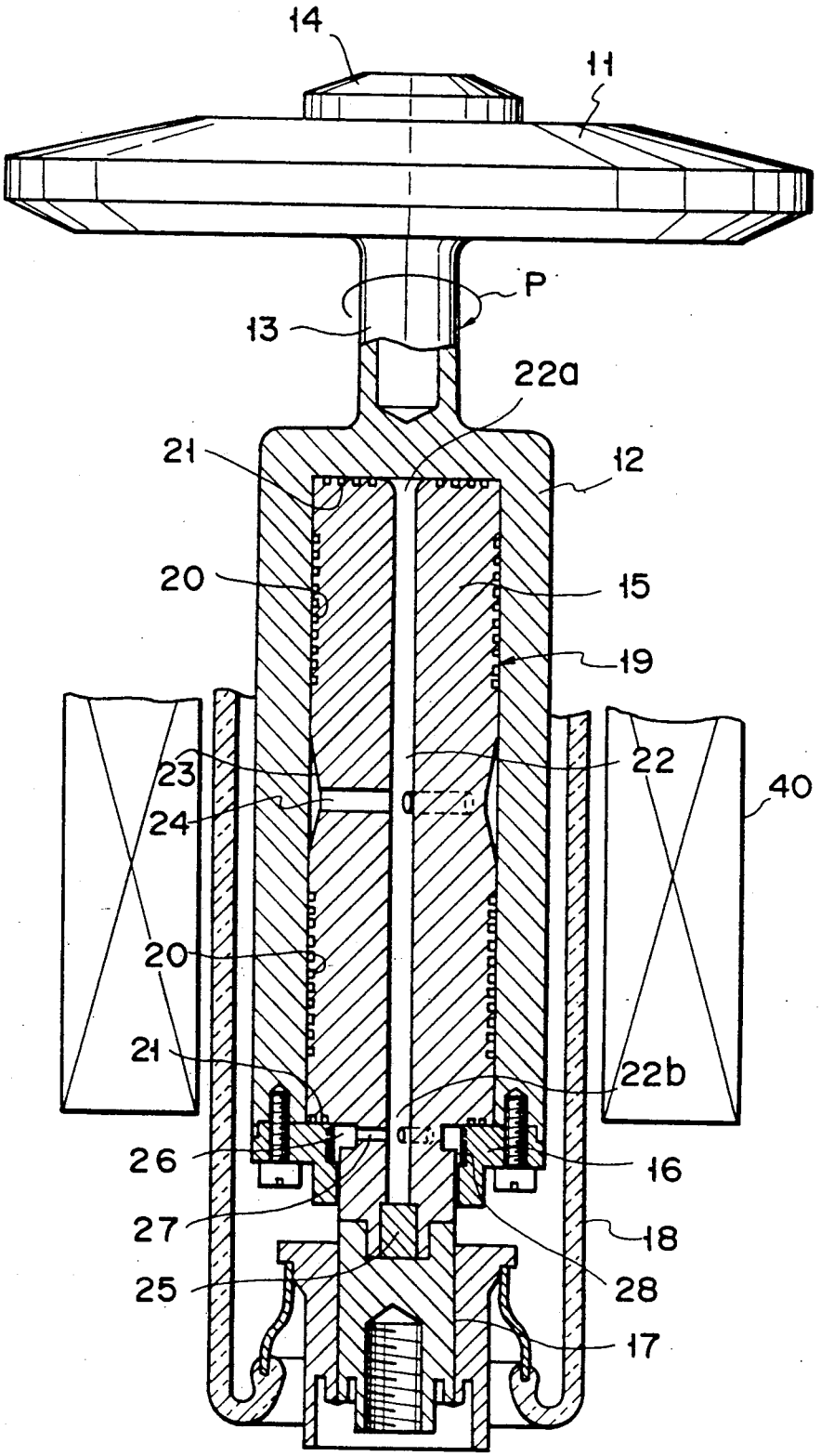
FIG. 1 is a longitudinal sectional view schematically showing a rotary-anode type X-ray tube according to an embodiment of the present invention.

A rotary-anode type X-ray tube shown in FIGS. 1 to 4 has the following structure. As shown in FIG. 1, a disk-like anode target 11 consisting of a heavy metal is integrally fixed to a rotating shaft portion 13 extending from one end of a cylindrical rotary structure 12 with a set screw 14. A columnar stationary shaft 15 is coaxially fitted in the cylindrical rotary structure 12. A ring-like opening sealing member 16 is fixed to the opening portion of the rotary structure 12. The end portion of the stationary shaft 15 is coupled to an anode support portion 17, which is airtightly fitted in a glass vacuum envelope 18. The fitting portion between the cylindrical rotary structure 12 and the stationary shaft 15 is formed into a hydrodynamic pressure type sliding bearing portion 19 similar to the one disclosed in the above-mentioned official gazettes. That is, spiral grooves 20 and 21 formed as herringbone patterns disclosed in the above-mentioned official gazettes are respectively formed in the outer surface and two end faces, of the stationary shaft 15, which serve as the sliding bearing surface on the stationary shaft side. The sliding bearing surface, on the rotary structure side, which opposes the sliding bearing surface on the stationary shaft side, is formed into a smooth surface or a surface in which spiral grooves are formed as needed. The two bearing surfaces of the rotary structure 12 and the stationary shaft 15 oppose each other and have a gap of 20 μm therebetween to form thrust and radial bearings.

Figure 2:
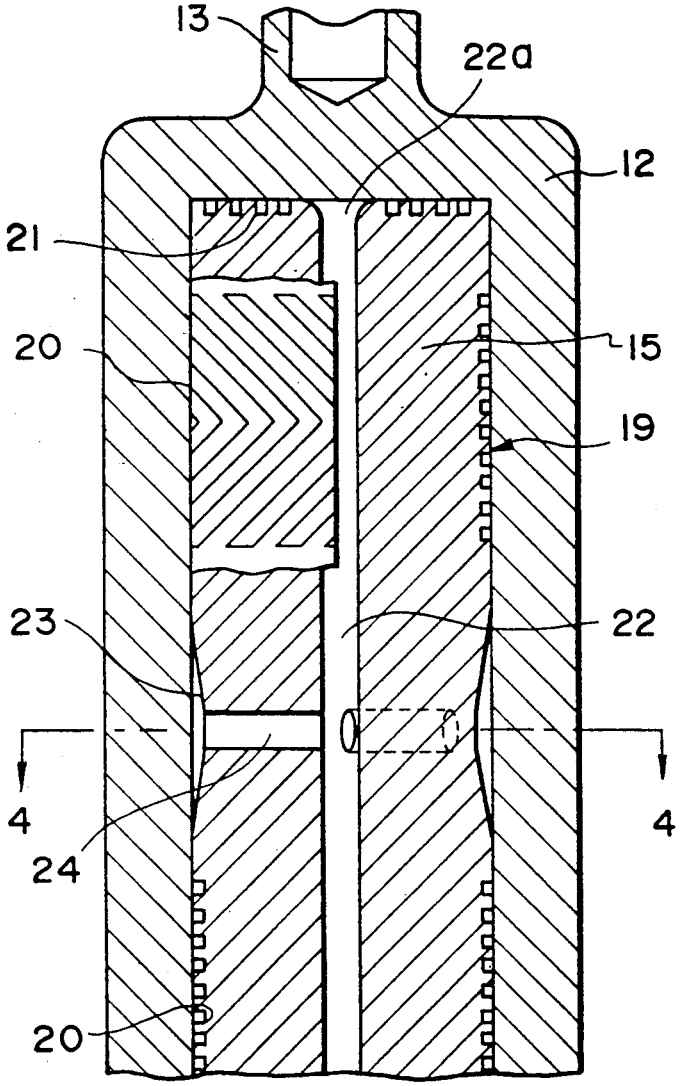
FIG. 2 is an enlarged sectional view showing a part of the rotary-anode type X-ray tube in FIG. 1.
Figure 3:
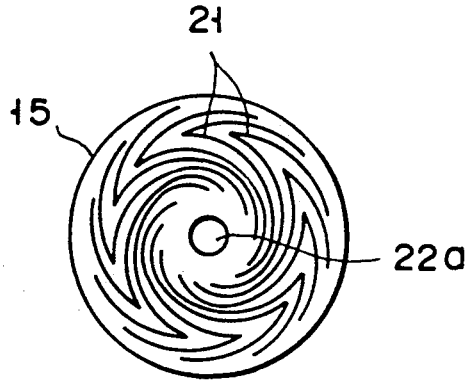
FIG. 3 is a top view showing a part of the rotary-anode type X-ray tube in FIG. 1.
Figure 4:
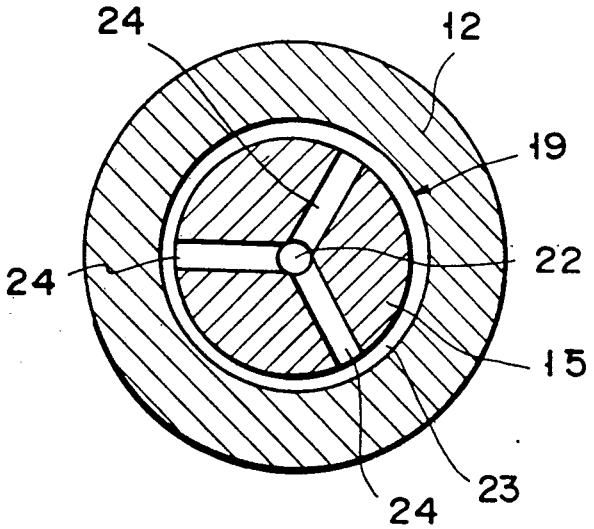
FIG. 4 is a cross-sectional view taken along a line 4—4 in FIG. 2.

A lubricant storage chamber 22 is formed in the stationary shaft 15 on a rotation center axis by boring a hole in the center of the member 15 along the axial direction. In addition, as shown in FIGS. 1 and 2, the outer surface of a middle portion of the stationary shaft 15 is tapered to form a small-diameter portion 23 having a surface region in which no spiral grooves are formed, and three radial paths 24 extending from the lubricant storage chamber 22 and opened in the small-diameter portion 23 are formed at angular intervals of 120° around the axis of the member 15 to be symmetrical about the axis. The lubricant paths 24 radially extending from the lubricant storage chamber 22 are communicated with a low-pressure space between the cylindrical rotary structure 12 and the small-diameter portion 23. The lubricant in the low-pressure space is maintained at a pressure lower than that of the gaps of the thrust and radial bearings. An end opening portion **22*a* of the lubricant storage chamber 22 is opened in the central region of the end face of the stationary shaft 15, the end opening 22*a* being surrounded by the spiral grooves 21. The spiral grooves 21 as the thrust bearing are formed in the other region of the end face and the lubricant storage chamber 22 is communicated with the gap in this thrust bearing through the end opening portion 22*a*. A portion, of the stationary shaft 15, which is located near the opposite end face is cut to form a small-diameter portion so as to form a circumferential recess 26. Spiral grooves 21 formed as circular herringbone patterns are formed in the opposite end face of the stationary shaft 15. Three radial paths 27 extending from the circumferential cavity 26 and communicating with the lubricant storage chamber 22 are formed at angular intervals of 120° around the axis of the chamber 22 to be symmetrical about the axis. With this structure, a communication section 22*b* the lubricant storage chamber 22 communicates with the gap of the thrust bearing through the radially extending holes 27 and the circumferential cavity 26. Note that the lubricant storage chamber 22 is sealed by a plug 25 consisting of the same material as that for the stationary shaft 15. Spiral grooves 28 having a pumping effect are formed in the inner surface of the sealing member 16 so as to prevent the lubricant from leaking into the space in the tube through the gap between the stationary shaft 15 and the sealing member 16**.

A liquid metal lubricant (not shown) is filled in the gaps in the sliding bearing portion 19 and the spiral grooves 20 and 21 and stored in the lubricant storage chamber 22 and the radially extending lubricant paths 24. In this rotary-anode type X-ray tube, an electromagnetic coil 40 as a stator is arranged to oppose the rotary structure 12 outside the vacuum envelope 18, and a rotating magnetic field is generated by the electromagnetic coil 40 to rotate the rotary anode 11 at a high speed, as indicated by an arrow P in FIG. 1. The liquid metal lubricant sufficiently fills the sliding bearing portion 19, at least during an operation of the X-ray tube, to allow a smooth dynamic pressure bearing operation. The spiral grooves formed as the herringbone patterns serve to concentrate this liquid metal lubricant toward their central portions to increase the pressures thereat, so that the lubricant flows to maintain a predetermined gap between the bearing surfaces, thus contributing to a stable dynamic pressure bearing effect. The lubricant stored in the lubricant storage chamber 22 is supplied into gaps in bearing surface portions, when an amount of the lubricant is decreased in the gaps of the bearing, thereby ensuring a stable operation of the dynamic pressure type sliding bearing portion. Note that an electron beam emitted from a cathode (not shown) is inpinged on the anode target 11 to irradiate X-rays. Most of the heat generated by this target is dissipated by radiation, while part of the heat is transferred from the rotary structure 12 to the liquid metal lubricant in the bearing portion 19 and is dissipated through the stationary shaft 15.

Figure 5:
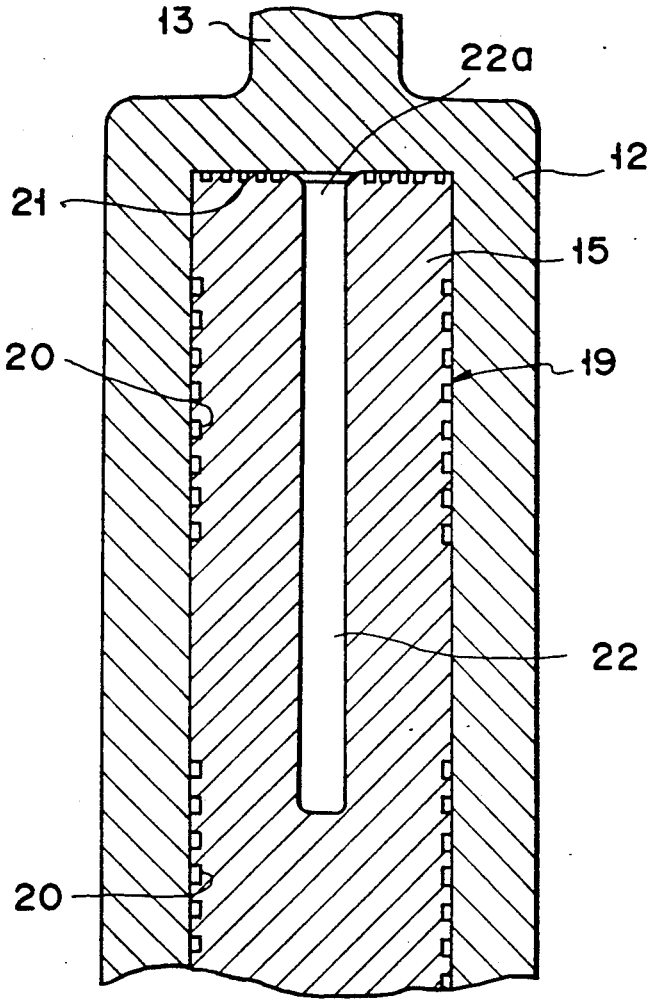
FIG. 5 is a longitudinal sectional view schematically showing a rotary-anode type X-ray tube according to another embodiment of the present invention.

In the embodiment shown in FIG. 5, a lubricant storage chamber 22 is constituted by a hole extending halfway in a columnar stationary shaft from the one end face. The opening portion **22*a* of the lubricant storage chamber 22 is opened in the central region of a bearing surface in which spiral grooves 21 are not formed. Similar to the above embodiment, a liquid metal lubricant is stored in this lubricant storage chamber 22. According to the structure shown in FIG. 5**, the lubricant storage chamber can be easily manufactured.

Figure 6:
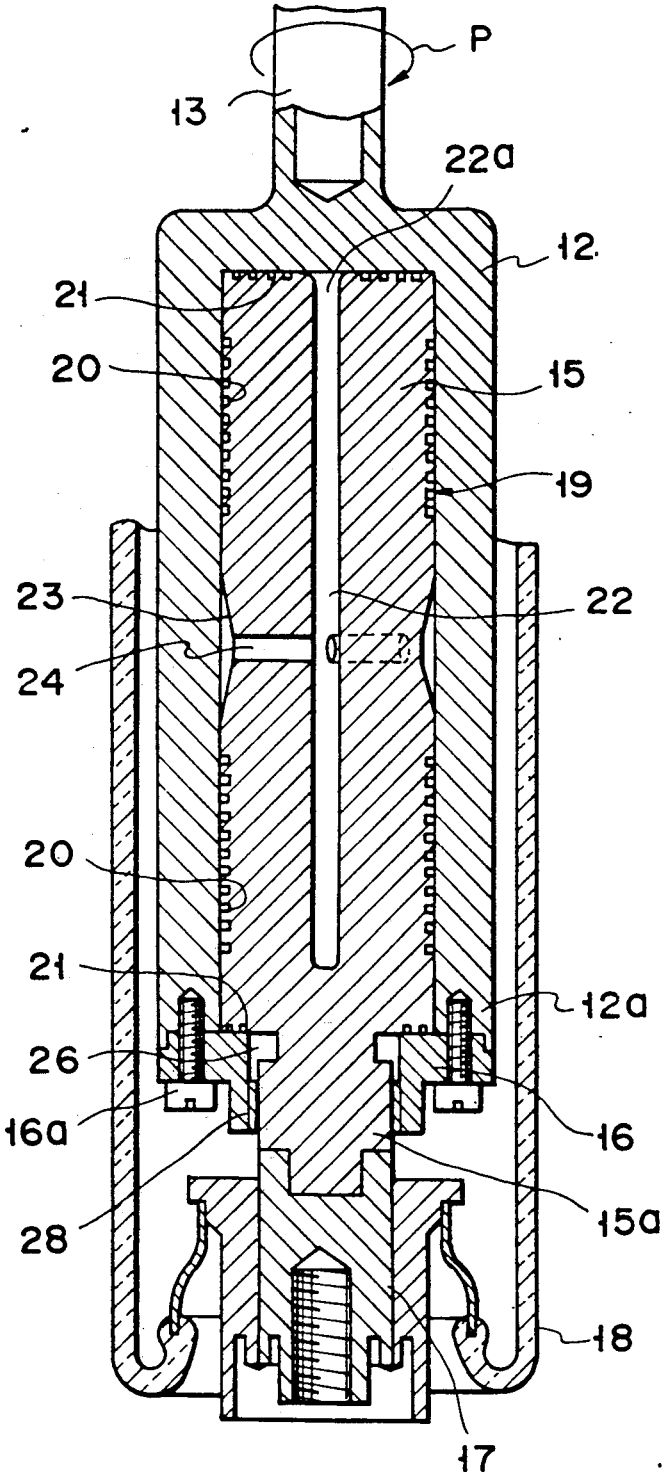
FIG. 6 is a longitudinal sectional view schematically showing a rotary-anode type X-ray tube according to still another embodiment of the present invention.

In the embodiment shown in FIG. 6, a hole is bored in the center of a stationary shaft 15 along the axial direction to extend halfway in the member 15, thus forming a lubricant storage chamber 22. In addition, three radial paths 24 extending from the lubricant storage chamber 22 are formed at angular intervals of 120° around the axis of the stationary shaft 15 to be symmetrical about the axis. These paths 24 are opened in an intermediate portion in which two sets of spiral grooves of a radial bearing are not formed.

According to the embodiments shown in FIGS. 5 and 6, since each lubricant storage chamber has no path communicating with the recess 26 formed near the opening of the rotary structure 12, the lubricant, which fills the lubricant storage chamber and the gaps in the bearing surfaces, does not easily leak into the space in the tube through the gaps between the bearing surfaces, the stationary shaft, and the sealing member, thereby maintaining a stable operation of the dynamic pressure type sliding bearing for a long period of time.

Figure 7:
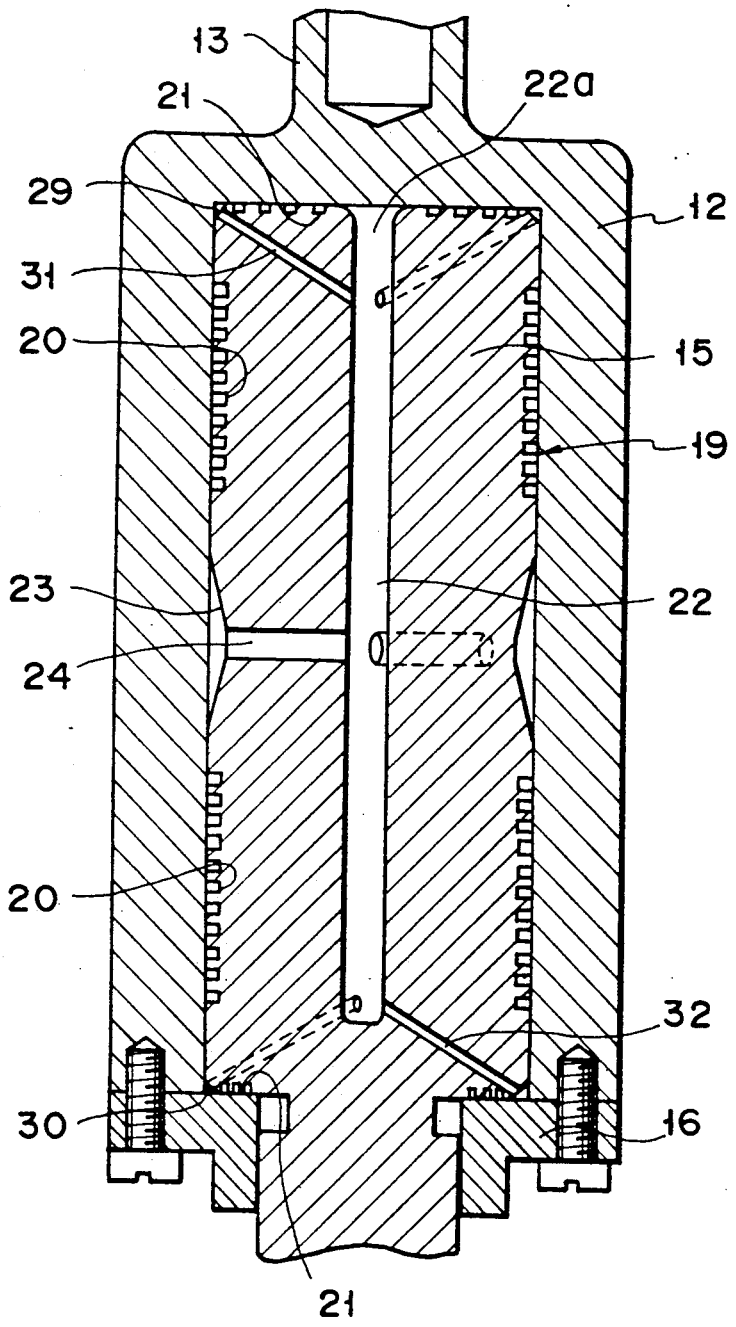
FIG. 7 is a longitudinal sectional view schematically showing a rotary-anode type X-ray tube according to yet another embodiment of the present invention.

In the embodiment shown in FIG. 7, three each of inclined paths 31 and 32 are formed at angular intervals of 120° around the axis of a stationary shaft 15 to be symmetrical about the axis. These paths 31 and 32 are respectively opened in corner portions 29 and 30, of the stationary shaft 16, corresponding to the boundaries between spiral grooves 20 constituting a radial sliding bearing and spiral grooves 21 constituting a thrust sliding bearing. With this structure, a lubricant in a lubricant storage chamber is supplied to low-pressure portions between the respective spiral grooves through the respective paths during an operation of the X-ray tube, thus ensuring a more stable dynamic pressure bearing operation.

Figure 8:
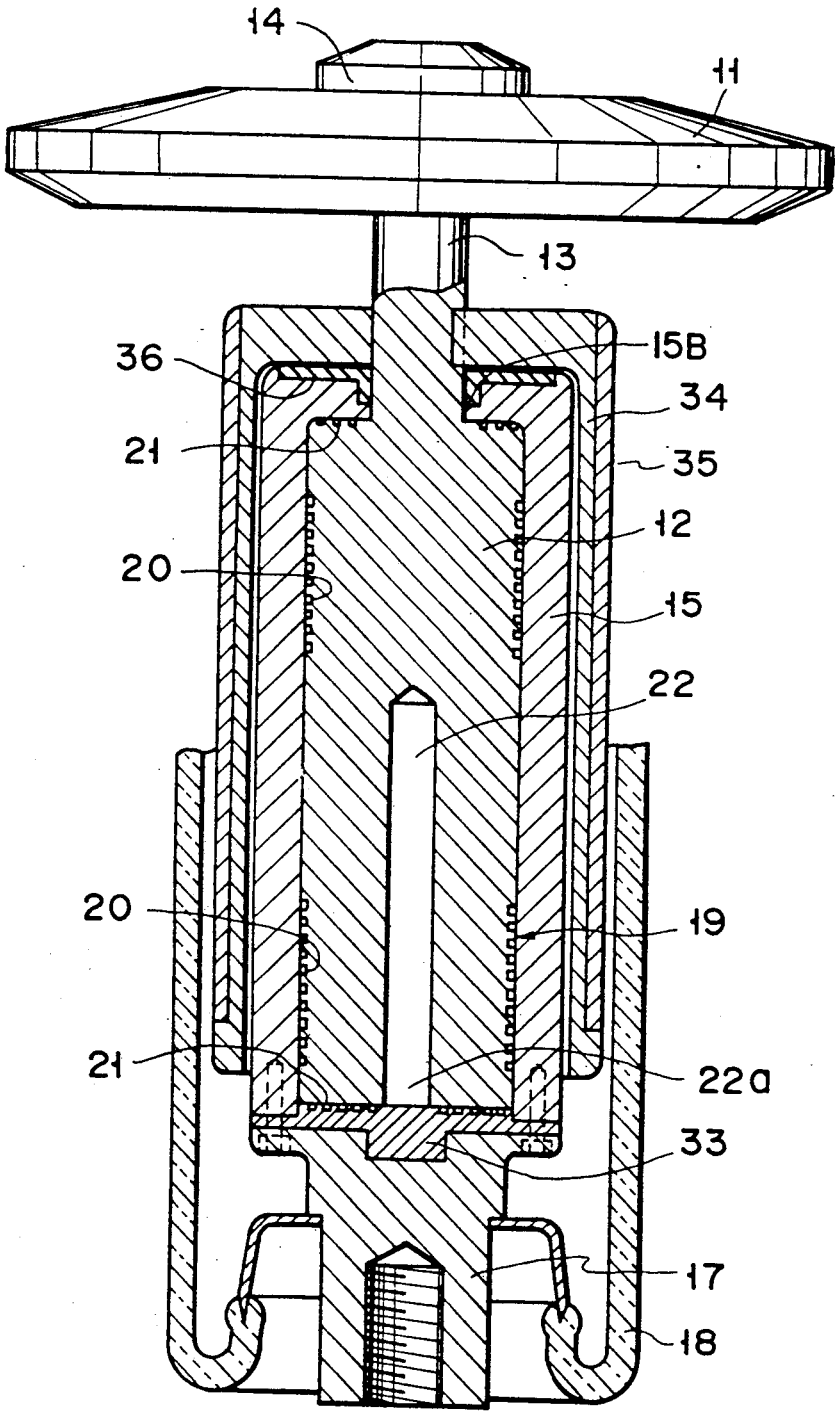
FIG. 8 is a longitudinal sectional view schematically showing a rotary-anode type x-ray tube according to a further embodiment of the present invention.

In the embodiment shown in FIG. 8, a columnar rotary structure 12 to which an anode target 11 is integrally coupled and rotated is arranged on a rotation center axis. A cylindrical stationary shaft 15 is arranged to surround the rotary structure 12. A through hole 15B is formed in the closed end portion of the stationary shaft 15 to allow a rotating shaft 13 to extend therethrough. A disk-like sealing member 33 and an anode support portion 17 are fixed to the opening end portion of the stationary shaft 15 with a plurality of screws. The sealing member 33 is in contact with the end face of the rotary structure 12 and has spiral grooves 21 formed in the contact surface. A ferromagnetic cylinder 34 serving as the rotor of a motor, and an outermost copper cylinder 35 are coaxially arranged around the stationary shaft 15. The ferromagnetic cylinder 34 is mechanically firmly fixed to the rotating shaft 13.

A lubricant storage chamber 22 is formed in the rotary structure 12 on the rotation center axis by a hole which is bored halfway in the member 12 along the center axis. An opening portion **22*a* of the lubricant storage chamber 22 is opened in a center region of the trush bearing, which has no spiral grooves, and communicates with the gaps in the bearing surface. In order to prevent a lubricant from leaking out from the bearing portion, a lubricant leakage preventing ring 36 is fitted in the though hole 15B of the cylindrical stationary shaft 15. The ring 36** consists of a ceramic material, e.g., alumina ($Al_2O_3$), boron nitride (BN), or silicon nitride ($Si_3N_4$), which is hardly wetted with a liquid metal lubricant and substantially repels it.

In this rotary-anode type X-ray tube, the metal lubricant stored in the lubricant storage chamber on the rotation center axis sufficiently fills the bearing portions during an operation to allow a smooth dynamic pressure bearing operation.

Figure 9:
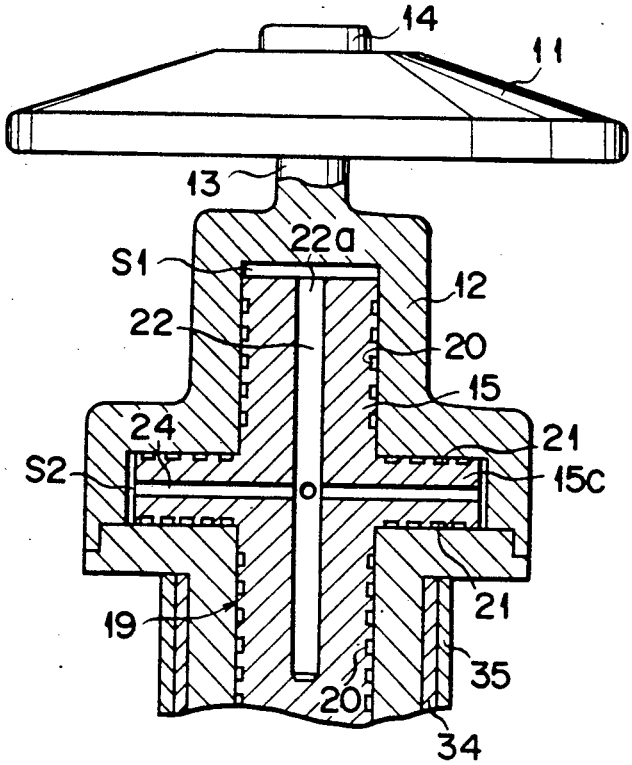
FIGS. 9 and 10 are logitudinal sectional views schematically showing a rotary-anode type X-ray tube according to still further embodiment of the present invention.

In the embodiment shown in FIG. 9, the stationary shaft 15 has a large diameter disk section **15*c* which is arranged at an intermediate portion of the stationary shaft 15 and spiral grooves of herringbone patterns is formed on the outer surfaces of the disk section 15*c* to constitute a thrust bearing. Spiral grooves 20 constituting a radial bearing are formed on the outer surfaces of the stationary shaft 15 to constitute a radial bearing. The lubricant storage chamber 22 formed in the stationary shaft 15 has an opening 22*a* which is communicated with a gap S1 between the end face of the stationary shaft 15 and the inner end face of the rotary structure 12. The gap S1 is also communicated with the spiral grooves 20 and the gap of the radial bearing. The paths 24 are formed in the disk section 15*c* of the stationary shaft in the radial direction thereof, are opened at the peripheral outer surface of the disk section 15*c* and the inner surface of the rotary structure. The lubricant received in the gaps S1, S2 in which the lubricant storage chamber 22 and the paths 24 are opened is maintained at a pressure lower than that of the gaps of the thrust and radial bearings during the rotating operation of the rotary structure 12**.

Figure 10:
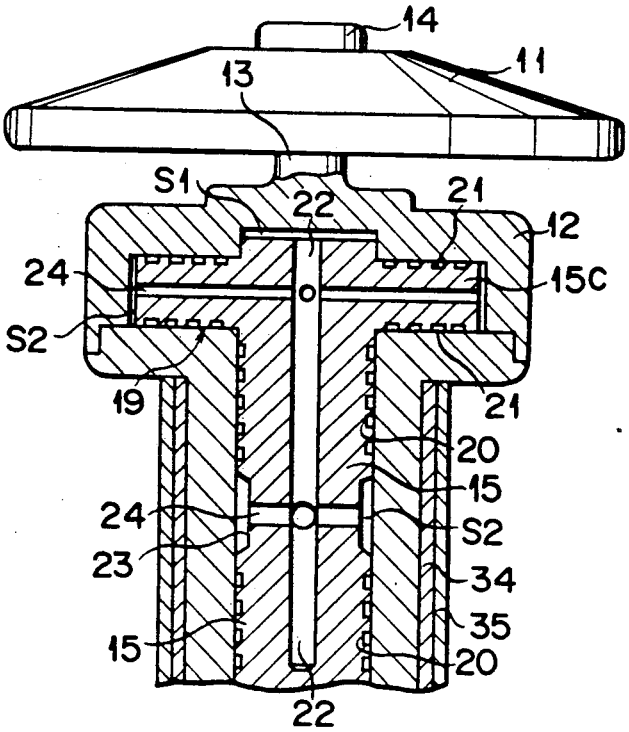

In an embodiment shown in FIG. 10, the large diameter disk section **15*c* is provided at the anode side on the stationary shaft 15. The spiral grooves 21 are formed on the outer surfaces of the disk section 15*c* to constitute the thrust bearing. The lubricant storage chamber 22 have an opening 22*a* in the gap S1 and is communicated with the gap of the radial bearing. The paths 24 extending in the radial direction of the shaft 15 is opened in the gap S2 between a small diameter section 23 of the shaft 15 and the inner surface of the rotary structure 12** and is communicated with the gaps of the radial bearings.

In the embodiment shown in FIGS. 5 to 10, the lubricant storage chamber 22 and the paths 24, 31, 32 are designed to have a total volume which is sufficiently larger than that of the gaps and the spiral grooves of the thrust and radial bearings.

In the above described embodiment, the lubricant storage chamber 22 is formed along the center axis of the rotary structure or stationary shaft. However, the lubricant storage chamber may be formed so as to off set from the center axis or to be inclined to the center axis. It is not limited to a signal lubricant storage chamber 22 but a plurality of lubricant storage chambers 22 may be formed. The chamber 22 may not be formed in a straight hole but in a bent hole.

A lubricant essentially consisting of Ga such as a Ga, Ga-In, or Ga-In-Sn lubricant, may be used. However, the present invention is not limited to this. For example, a lubricant consisting of an alloy containing a relatively large amount of In, e.g., an In-Bi or In-Bi-Sn alloy, may be used. Since these materials have melting points higher than the room temperature, it is preferably that a metal lubricant consisting of such a material be preheated to a temperature higher than its melting point before an anode target is rotated.

As has been described above, according to the present invention, a lubricant storage chamber for storing part of a lubricant is formed in a stationary shaft or a rotary structure on the rotation center axis to communicate with the bearing surfaces of a sliding bearing portion. With this structure, a sufficient amount of lubricant required for a long-term operation can be stored, and the lubricant evenly flows in the sliding bearing portion during an operation, thus obtaining a proper lubricating function.

That is, a rotary-anode type X-ray tube capable of performing a stable bearing operation for a long period of time can be obtained.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A rotary-anode type X-ray tube comprising:

an anode target;

a rotary structure which has a rotation center axis and to which said anode target is fixed;

a stationary structure, coaxially arranged with said rotary structure, for rotatably supporting said rotary structure, said stationary structure having an opening on its outer surface where a low pressure is generated; and a hydrodynamic bearing formed between said rotary structure and said stationary structure at a portion other than where said opening on the outer surface of said stationary structure is located, said hydrodynamic bearing having a gap in which a metal lubricant is applied, the metal lubricant being in liquid state during rotation of said rotary structure, a vacuum envelope in which said rotary and stationary structures and said hydrodynamic bearing are installed, a lubricant storage chamber for receiving the metal lubricant, said lubricant storage chamber formed in said stationary structure, said stationary structure being arranged on the rotation center axis, said lubricant storage chamber communicating with the gap in said hydrodynamic bearing via said opening in the outer surface of said stationary structure.

2. An X-ray tube according to claim 1, wherein said hydrodynamic lubricant storage chamber has a volume which is larger than that of the gap of said bearing.

3. An X-ray tube according to claim 1, wherein said lubricant storage chamber is formed along the rotation center axis.

4. An X-ray tube according to claim 1, wherein said hydrodynamic bearing includes a thrust-bearing having a gap and said lubricant storage chamber has an opening communicating with the gap of the thrust bearing.

5. An X-ray tube according to claim 1, wherein said hydrodynamic bearing includes radial bearings having gaps and said lubricant storage chamber includes a path having an opening arranged between said radial bearings and communicating with the gaps of said radial bearings.

6. An X-ray tube according to claim 5, wherein said rotary and stationary structures define a low-pressure space formed therebetween, said low-pressure space is arranged between said radial bearings and communicates with the gaps of said radial bearings and said lubricant storage chamber; and the opening of said lubricant storage chamber opens into said low-pressure storage space.

7. An X-ray tube according to claim 1, wherein said hydrodynamic bearing includes thrust and radial bearings having gaps, and said lubricant storage chamber includes a path having an opening between said thrust and radial bearings, the path communicates with the gaps of said thrust and radial bearings.

8. An X-ray tube according to claim 1, further comprising sealing means for sealing said hydrodynamic bearing.

9. An X-ray tube according to claim 8, wherein said sealing means includes a cavity defined by said rotary and stationary structures, and said cavity communicates with the gap of said hydrodynamic bearing and said lubricant storage chamber.

10. An X-ray tube according to claim 1, wherein said lubricant chamber has an opening which communicates with the gap of said hydrodynamic bearing, the rotation center axis passing through the opening.

11. An X-ray tube according to claim 1, wherein said stationary structure has a columnar shape and is rotatably inserted in the rotary structure, and said lubricant storage chamber is formed in said stationary structure.

12. An X-ray tube according to claim 11, wherein said stationary structure has an outer surface, said rotary structure has an inner surface and said hydrodynamic bearing includes spiral grooves formed on at least one of the outer surface of said stationary structure and the inner surface of said rotary structure.

13. An X-ray tube according to claim 1, wherein said rotary structure has a columnar shape and is inserted in said stationary structure and said lubricant storage chamber is formed in said rotary structure.

14. An X-ray tube according to claim 13, wherein said rotary structure has an outer surface, said stationary structure has an inner surface and said hydrodynamic bearing includes spiral grooves formed on at least one of the outer surface of said stationary structure and the inner surface of said rotary structure.

* * * * *